US005220967A

United States Patent [19]

Monyak

[11] Patent Number: 5,220,967

[45] Date of Patent: Jun. 22, 1993

[54] DRILL AND SELF-CENTERING CUTTER INSERT THEREFOR

[75] Inventor: Kenneth S. Monyak, Abingdon, Va.

[73] Assignee: Sandvik Rock Tools, Inc., Bristol, Va.

[21] Appl. No.: 764,216

[22] Filed: Sep. 23, 1991

[51] Int. Cl.[5] ..... E21B 13/01

[52] U.S. Cl. ..... 175/420.1; 175/426; 175/432

[58] Field of Search ..... 175/420.1, 426, 428, 175/431, 432

[56] References Cited

U.S. PATENT DOCUMENTS

| | | | |
|---|---|---|---|
| 993,972 | 5/1911 | English | 175/420.1 X |
| 2,097,030 | 10/1937 | Killgore | 175/426 |
| 3,006,424 | 10/1961 | Dahlin et al. | 175/420.1 |
| 3,749,190 | 7/1973 | Shipman | 175/426 |
| 4,109,737 | 8/1978 | Bovenkerk | 175/329 |
| 4,199,035 | 4/1980 | Thompson | 175/432 |
| 4,313,506 | 2/1982 | O'Connell | 175/410 |
| 4,782,903 | 11/1988 | Strange | 175/410 |

*Primary Examiner*—William P. Neuder

*Attorney, Agent, or Firm*—Burns, Doane, Swecker & Mathis

[57] ABSTRACT

A drill for cutting holes in mine roofs comprises a shank and a wedge shaped carbide cutting insert frictionally clamped within a wedge-shaped slot formed in the front end of the shank. The insert and slot include a tongue-and-recess connection which radially centers the insert within the slot.

18 Claims, 2 Drawing Sheets

FIG. 1
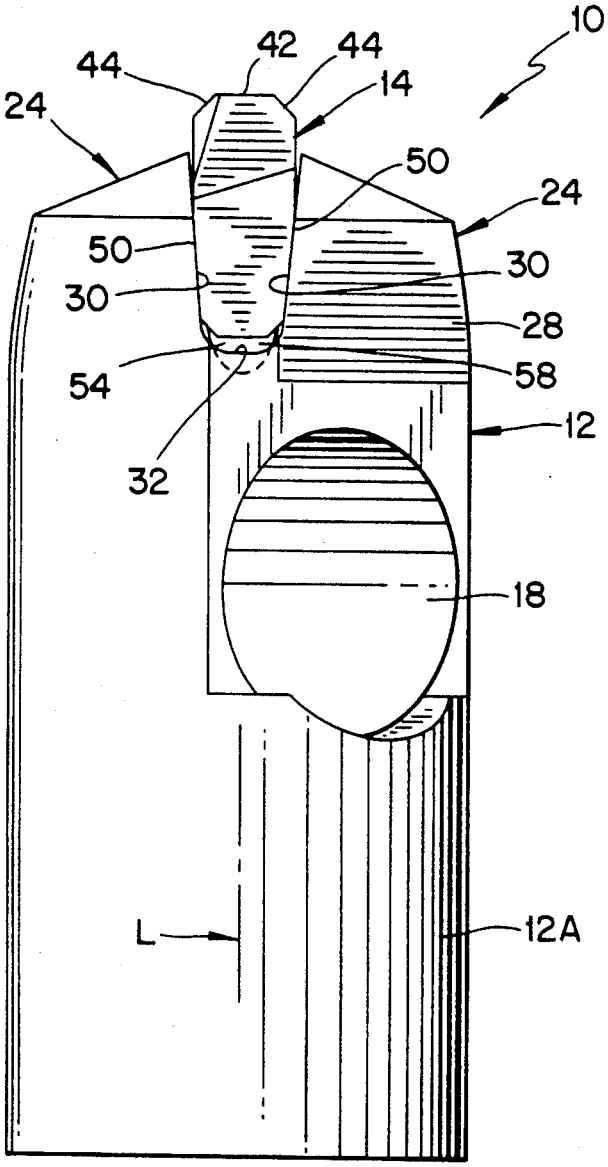
FIG. 2
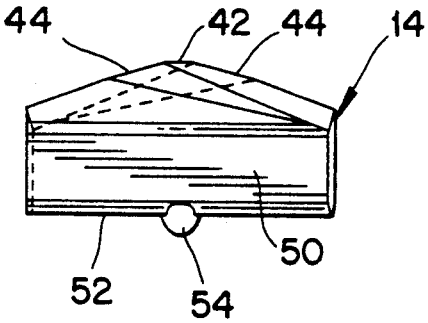
FIG. 3
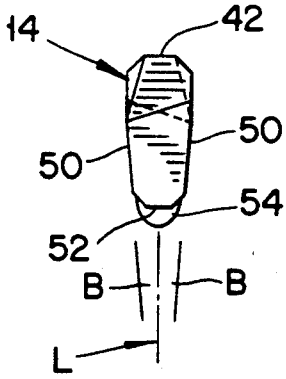
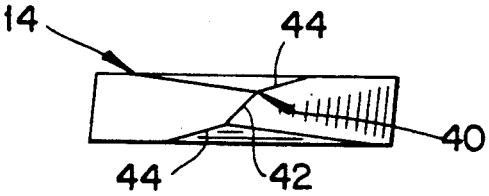
FIG. 4

DRILL AND SELF-CENTERING CUTTER INSERT THEREFOR

BACKGROUND OF THE INVENTION

The present invention relates to drill bits for drills, especially for drills of the type used for roof drilling in mines.

Drills of that type are used for drilling holes in mine roofs for the purpose of installing roof bolts, for example. Attention is directed to U.S. Pat. No. 4,313,506 for a disclosure of such a drill.

In general, a drill of that type includes a hollow shank having an interior axial bore which is open axially rearwardly. A lateral opening extends through the shank and communicates with a forward end of the bore. At its front end the shank includes a radial slot in which a plate-like cutter insert or bit is fastened, usually by brazing. The insert includes a pair of cutting edges disposed ahead of two compression faces defined by the shank.

During a drilling operation, cuttings from the insert travel along the compression faces and are acted on by those faces so as to be progressively reduced to a dust-like consistency. The dust-like material travels into the lateral opening and then rearwardly through the bore.

When the insert becomes worn and requires resharpening or replacement, it is necessary to break the braze connection between the shank and the insert in order to be able to remove the insert.

It will be desirable to be able to eliminate the time and expense involved in braking a braze connection in order to remove the bit.

SUMMARY OF THE INVENTION

The present invention relates to a drill, and a cutting insert for use in a drill. The drill comprises a generally cylindrical body which defines a longitudinal axis of rotation and includes a pair of forwardly projecting clamp members disposed on opposite sides of the axis. The clamp members define therebetween a generally radial slot which is open at its forward end and at both of its radial ends. Each of the clamp members includes a first wedge surface defining a side wall of the slot and being inclined such that the slot is tapered rearwardly. A plate-like cutting insert is removably wedged in the slot. The insert is formed of a harder material than the body and includes a cutting edge at its forward end. The insert also includes a pair of wedge surfaces inclined such that the insert tapers in a rearward direction. The first wedge surfaces engage respective ones of the second wedge surfaces such that the clamping members frictionally grip the insert. The insert and the body include first and second interengaging cutting surfaces for radially centering the insert in the slot.

Preferably, the interengaging centering surfaces are formed by a tongue-and-recess connection between a rear face of the insert and a rear wall of the slot.

Preferably, the tongue projects from the rear face and the recess is formed in the rear wall.

The tongue is preferably conically shaped and extends from the center of the rear face.

BRIEF DESCRIPTION OF THE DRAWINGS

FIG. 1 is a side elevational view of a mine roof drill bit wherein a cutting insert is mounted in a shank portion of the bit;

FIG. 2 is a side elevational view of the cutting insert depicted in FIG. 1;

FIG. 3 is an end elevational view of the cutting insert depicted in FIG. 1;

FIG. 4 is a plan view of the cutting insert depicted in FIG. 1;

DETAILED DESCRIPTION OF A PREFERRED EMBODIMENT OF THE INVENTION

Figure 5:
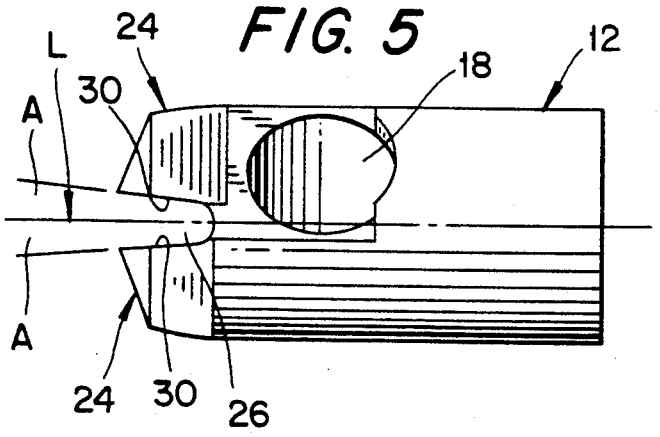
FIG. 5 is a side elevational view of the shank depicted in FIG. 1.
Figure 6:
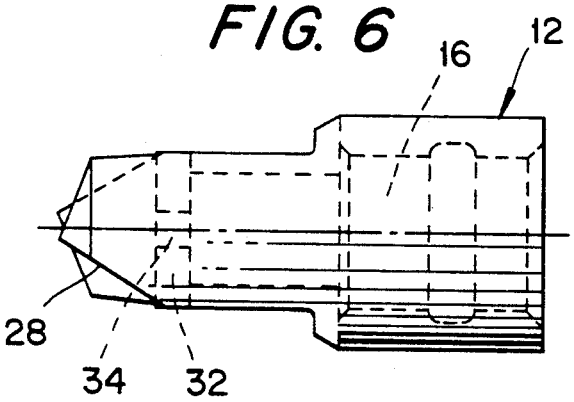
FIG. 6 is a side elevational view of the shank turned by 90° relative to the FIG. 5 showing.
Figure 7:
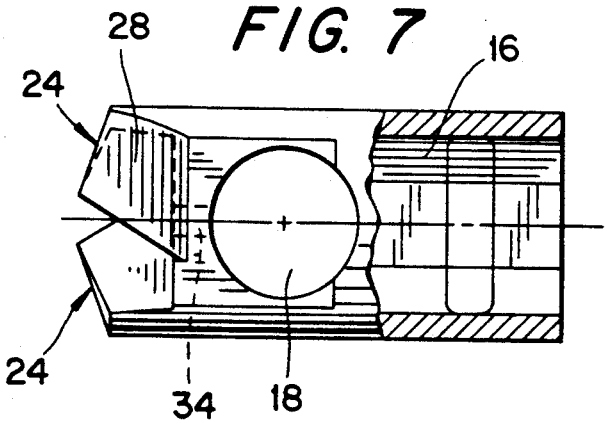
FIG. 7 is a side elevational view of the shank, partially broken away, with the shank formed by 180° relative to the FIG. 5 showing.
Figure 8:
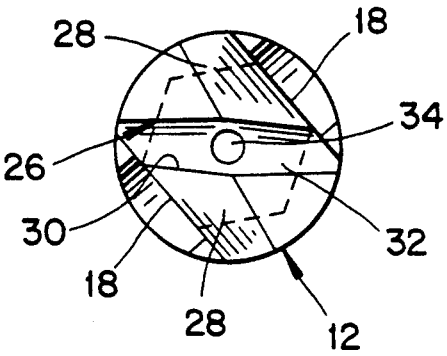
FIG. 8 is a front end view of the shank depicted in FIG. 5.
Figure 9:
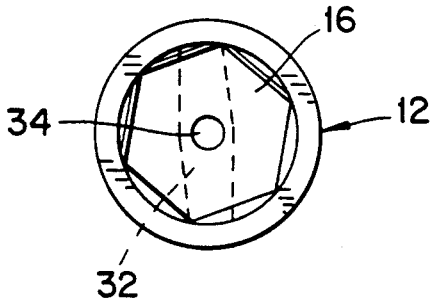
FIG. 9 is a rear end view of the shank depicted in FIG. 5.
Figure 10:
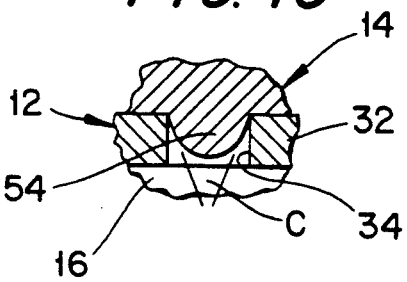
FIG. 10 is an enlarged fragmentary view of a portion of the insert mounted in the shank.

A drill 10 depicted in FIG. 1 comprises a shank 12 and a cutting insert 14 mounted at a front end of the shank 12, The shank 12 comprises a cylindrical rear body portion 12A which is rotatable about its longitudinal axis L. The rear body formation 12A includes a rearwardly open axial bore 16 (see FIG. 9) . Adjacent a forward end of the axial bore 16 two radial holes 18 extend completely through the cylindrical body. The bore 16 is of polygonal cross section as is evident from FIG. 8 and is adapted for connection to a conventional rotary drive element (not shown).

Projecting forwardly at the front end of the rear body portion 12A are two clamping members 24 disposed on opposite sides of the axis L. The clamping members 24 are spaced apart to define a radial slot 26 therebetween. The slot is open at its forward end and at both radial ends. At its outer periphery, each clamping member 24 includes an inclined compression surface 28 which extends toward a respective one of the radial holes 18.

At its inner periphery, each clamping member 24 includes a wedge surface 30 which defines a side wall of the slot 26. Each wedge surface 30 is inclined at an angle A relative to the longitudinal axis L, whereby the slot tapers rearwardly to define an included angle equal to two times the angle A (i.e., 2A). The angle A is preferably in the range of 2.0° to 10.0°, more preferably in the range of 3.0 to 7.5°, and most preferably about 5°.

A rear end of the slot 26 is closed by a rear wall 32. Formed at the center of the slot coaxially with the axis L is a recess in the form of a cylindrical bore 34.

The insert 14 is of plate-like configuration and comprises a cutting edge 40 on its forward face. The cutting edge 40 includes a center chisel portion 42 and two side portions 44. The insert 14 is formed of a harder material than the body 12. For example, the insert may be formed of carbide, and the body 12 of steel.

The insert includes two wedge surfaces 50 which extend rearwardly from the front face and which are inclined at an angle B relative to the axis L such that the insert tapers rearwardly to define an included angle of two times the angle B, as is evident from FIG. 3. The angle B preferably corresponds to the angle A, i.e., is preferably from 2.0° to 10.0°, more preferably from 3.0° to 7.5°, and most preferably about 5.0°.

When the insert is forced rearwardly into the slot 26, preferably in a jig, the wedge surfaces 50 become frictionally clamped between the clamping members 24. The clamping members 24 may be slightly elastically deflected outwardly by the wedge surfaces 50 so as to be biased strongly inwardly against the wedge surfaces.

During cutting operations, it is important that the insert 14 be radially centered within the slot 26. That is achieved by means of a tongue 54 which projects rearwardly from the center of a rear surface 52 of the insert. The tongue is generally conical in shape and is thus tapered rearwardly to form an included angle C when the insert is viewed in a direction perpendicularly to the plane of the insert (e.g., as viewed in FIG. 2). The included angle C is preferably from 20° to 60°, more preferably from 30° to 50°, and most preferably about 40°.

The tongue 54 lies at the geometric center of the insert, so that when the tongue 54 is aligned with the axis L, i.e., when the tongue 54 is inserted within the bore 34, the insert will be radially centered in the slot. The largest diameter of the tongue 54 is substantially equal to the diameter of the bore 34. Due to the tapered configuration of the tongue 54, the insert 14 need not be perfectly centered when initially entering the slot. That is, even if the tongue 54 is initially slightly offset from the axis L, the insert will center itself as it progressively travels into the bore 34. Moreover, during a cutting operation, the presence of the tongue 54 in the bore 34 will prevent radial displacement of the insert.

It will thus be appreciated that the tongue and bore form cooperating centering surfaces which radially center the insert. Other types of centering surfaces could be provided instead. Alternatively, the tongue and slot could be reversed, i.e., the tongue formed on the rear wall of the slot, and the recess formed in the rear surface of the insert.

The insert 14 is forcefully inserted into the shank 12 in any suitable mechanism, such as a jig. The wedge surfaces 50 of the insert bear frictionally against the wedge surfaces 30 of the slot. The wedge surfaces 50 may slightly elastically deflect the clamping members 24 radially outwardly, whereupon the clamping members will be inherently biased radially inwardly to press tightly against the insert. During the insertion of the insert, the tongue 54 enters the recess 34 formed in the rear wall 32 of the slot. Since the tongue 54 is tapered, it automatically produces a self-centering of the insert in a radial direction as the tongue 54 progressively enters within the recess 34. Thus, it is only necessary to generally center the insert relative to the slot when inserting the insert in order to ensure that the insert will be radially centered.

During a cutting operation, the presence of the tongue 54 within the recess 34 will prevent radial displacement of the insert within the slot.

When the insert is worn and requires resharpening or replacement, a tool can be inserted into a space 58 situated between the rear face 52 of the insert and the rear wall 32 of the slot in order to pry the insert from the slot.

The present invention enables an insert to be securely retained in the shank without the need for brazing. Hence, removal of the insert from the shank is easier and less costly. Furthermore, there is no concern that the insert will become radially off-center during installation of the insert or operation of the drill, due to the centering action performed by the tongue-and-recess connection.

Although the present invention has been described in connection with a preferred embodiment thereof, it will be appreciated by those skilled in the art that additions, modifications, substitutions, and additions not specifically described may be made without departing from the spirit and scope of the invention as defined in the appended clams.

What is claimed is:

1. A drill comprising:

a shank body defining a longitudinal axis of rotation and including a generally cylindrical rear body portion and a pair of forwardly projecting clamp members disposed at a front end of said rear body portion on opposite sides of said axis, said clamp members defining therebetween a generally radial slot which is open at its forward end and at both of its radial ends, each of said clamp members including a first wedge surface defining a side wall of said slot, said first wedge surfaces converging rearwardly such that said slot is tapered rearwardly, a plate-like cutting insert removably wedged in said slot and formed of a harder material than said body, said insert including a cutting edge at its forward end, and a pair of second wedge surfaces, said second wedge surfaces converging rearwardly such that said insert tapers in a rearward direction, said first wedge surfaces engaging respective ones of said second wedge surfaces such that said clamp members frictionally grip said insert, said insert and said body including first and second centering surface means, respectively, said first and second centering surface means engaging one another for radially centering said insert in said slot.

2. A drill according to claim 1, wherein said first and second centering surface means are formed by a tongue-and-recess connection between said insert and said body.

3. A drill according to claim 1, wherein said first and second centering surface means are respectively disposed on a rear face of said insert and a rear wall of said slot which faces said rear face.

4. A drill according to claim 3, wherein said first and second centering surface means comprise a tongue-and-recess connection between said rear face and said rear wall.

5. A drill according to claim 4, wherein said tongue projects from said rear face, and said recess is formed in said rear wall.

6. A drill according to claim 4, wherein said tongue-and-recess lie on said axis.

7. A drill according to claim 6, wherein said tongue is generally tapered as said insert is viewed in a direction perpendicular to the plane of the insert.

8. A drill according to claim 7, wherein said tongue forms an included angle of from 20 to 60 degrees.

9. A drill according to claim 8, wherein said included angle is about 40 degrees.

10. A drill according to claim 1, wherein said recess comprises a cylindrical bore.

11. A drill according to claim 1, wherein said wedge surfaces form an included angle of from 5 to 20 degrees.

12. A drill according to claim 11, wherein said included angle is about 10 degrees.

13. A drill for drilling holes in mine roofs, comprising:

a shank body defining a longitudinal axis of rotation and including a generally cylindrical rear body portion and a pair of forwardly projecting clamp members disposed at a front end of said rear body portion on opposite sides of said axis and defining therebetween a generally radial slot which is open at a forward end and at both radial ends, each of said clamp members including a first wedge surface defining a side wall of said slot, said first wedge surfaces converging rearwardly such that said slot is tapered rearwardly, each clamp member including a pair of diametrically opposed, inclined compression faces disposed on an outer periphery thereof, said rear body portion including an axial bore which opens rearwardly and radial holes extending radially through said body at locations rearwardly of respective cutting faces, said radial holes communicating with a forward end of said axial bore, a plate-like cutting insert removably wedged in said slot, said insert formed of a harder material than said body and including a cutting edge at its forward end, said cutting edge including cutting edge portions disposed forwardly of respective ones of said compression faces, whereby cuttings cut by said cutting edge portions are crushed by said compression faces and travel into said radial holes and through said axial bore, said insert including a pair of second wedge surfaces, said second wedge surfaces converging rearwardly such that said insert tapers rearwardly, said first wedge surfaces engaging respective ones of said second wedge surfaces such that said clamp members frictionally grip said insert.

said insert and said body including interengaging first and second centering surface means, respectively, said first and second center surface means being interengaged for radially centering said insert in said slot.

14. A drill according to claim 13, wherein said first and second centering surface means are respectively disposed in a rear face of said insert and a rear wall of said slot which faces said rear face.

15. A drill according to claim 14, wherein said first and second centering surface means are formed by a tongue-and-recess connection between said rear face and said rear wall.

16. A cutting insert adapted for use in a drill shank for drilling holes in mine roofs, (said insert) comprising a plate-like body having a front face on which a cutting edge is formed, said cutting edge including a central chisel portion and two side portions extending outwardly therefrom, a pair of wedge surfaces extending rearwardly from said front face and converging rearwardly to form a taper, said insert including a rear face intersecting said wedge surfaces, and a rearwardly tapered tongue extending rearwardly from said rear face at a center of said rear face.

17. A cutting insert according to claim 16, wherein said tapered tongue forms an included angle of from 20 to 60 degrees.

18. A cutting insert according to claim 17, wherein said included angle is about 40 degrees.

* * * * *